US011181854B2

(12) United States Patent
Hemmi et al.

(10) Patent No.: US 11,181,854 B2
(45) Date of Patent: Nov. 23, 2021

(54) IMAGE FORMING APPARATUS

(71) Applicants: Kaori Hemmi, Kanagawa (JP); Koichi Kato, Kanagawa (JP); Kimiharu Yamazaki, Kanagawa (JP); Kazuyoshi Fushinobu, Tokyo (JP); Shunsuke Kawasaki, Tokyo (JP); Shinichi Kuramoto, Tokyo (JP)

(72) Inventors: Kaori Hemmi, Kanagawa (JP); Koichi Kato, Kanagawa (JP); Kimiharu Yamazaki, Kanagawa (JP); Kazuyoshi Fushinobu, Tokyo (JP); Shunsuke Kawasaki, Tokyo (JP); Shinichi Kuramoto, Tokyo (JP)

(73) Assignees: RICOH COMPANY, LTD., Tokyo (JP); TOKYO INSTITUTE OF TECHNOLOGY, Tokyo (JP)

( * ) Notice: Subject to any disclaimer, the term of this patent is extended or adjusted under 35 U.S.C. 154(b) by 0 days.

(21) Appl. No.: 17/030,491

(22) Filed: Sep. 24, 2020

(65) Prior Publication Data

US 2021/0088948 A1 Mar. 25, 2021

(30) Foreign Application Priority Data

Sep. 24, 2019 (JP) ..... JP2019-173128

(51) Int. Cl.
*G03G 15/20* (2006.01)
*G03G 15/00* (2006.01)

(52) U.S. Cl.
CPC ..... *G03G 15/2039* (2013.01); *G03G 15/5029* (2013.01); *G03G 15/6573* (2013.01);
(Continued)

(58) Field of Classification Search
CPC ..... G03G 15/2021; G03G 15/2039; G03G 15/2046; G03G 15/205; G03G 15/5029; G03G 15/6573; G03G 2215/00772
See application file for complete search history.

(56) References Cited

U.S. PATENT DOCUMENTS

2012/0093532 A1* 4/2012 Ishigaya ..... G03G 15/2039 399/69
2013/0149017 A1 6/2013 Amita et al.
(Continued)

FOREIGN PATENT DOCUMENTS

EP 0864942 A1 9/1998
JP H08-286551 11/1996
(Continued)

OTHER PUBLICATIONS

Machine translation of JP 2015-075693. Apr. 20, 2015. (Year: 2015).*

(Continued)

*Primary Examiner* — Carla J Therrien
(74) *Attorney, Agent, or Firm* — Harness, Dickey & Pierce, P.L.C.

(57) ABSTRACT

An image forming apparatus includes a plurality of temperature-influence members, a first-point temperature acquisition unit, a second-point temperature estimation unit, and a controller. The plurality of temperature-influence members have influence on a temperature of a recording medium on which an image is formed. The first-point temperature acquisition unit is configured to detect or estimate a temperature of the recording medium at a first point. The second-point temperature estimation unit is configured to estimate a temperature of the recording medium at a second point, based on a detection result of at least one of a temperature of the recording medium at a point different from the second point and a temperature of a member or atmosphere. The controller is configured to control the plurality of temperature-influence members, based on an acquisition result from the first-point temperature acquisition unit and an estimation result from the second-point temperature estimation unit.

17 Claims, 6 Drawing Sheets

(52) U.S. Cl.
CPC ..... *G03G 15/2021* (2013.01); *G03G 2215/00772* (2013.01)

(56) References Cited

U.S. PATENT DOCUMENTS

| | | | | |
|---|---|---|---|---|
| 2014/0044462 | A1* | 2/2014 | Ikeda | G03G 15/2017 399/341 |
| 2014/0099138 | A1 | 4/2014 | Ishigaya et al. | |
| 2014/0308058 | A1* | 10/2014 | Ikeda | G03G 15/2021 399/341 |
| 2014/0348522 | A1* | 11/2014 | Tomono | G03G 15/50 399/44 |
| 2016/0004193 | A1* | 1/2016 | Murrell | G03G 15/50 399/67 |
| 2016/0231670 | A1 | 8/2016 | Takahashi et al. | |

FOREIGN PATENT DOCUMENTS

| | | |
|---|---|---|
| JP | 5147323 | 12/2012 |
| JP | 2015-075693 | 4/2015 |
| JP | 2016-148706 | 8/2016 |

OTHER PUBLICATIONS

Extended European Search Report dated Mar. 17, 2021 issued in corresponding European Appln. No. 20197924.2.

* cited by examiner

IMAGE FORMING APPARATUS

CROSS-REFERENCE TO RELATED APPLICATIONS

The present application claims priority under 35 U.S.C. § 119 to Japanese Patent Application No. 2019-173128, filed on Sep. 24, 2019. The contents of which are incorporated herein by reference in their entirety.

BACKGROUND OF THE INVENTION

1. Field of the Invention

The present invention relates to an image forming apparatus.

2. Description of the Related Art

Conventionally, an image forming apparatus including a plurality of temperature-influence members having influence on the temperature of a recording medium on which an image is formed, has been known.

For example, Japanese Unexamined Patent Application Publication No. 2015-75693 discloses an image forming apparatus in which a toner image formed on a sheet (recording medium) is subjected to fixing processing by heat and pressure with a heating roller (temperature-influence member) and a pressing roller in a fixing device, and additionally the sheet having risen in temperature through the fixing device is subjected to cooling processing, in contact with a cooling member (temperature-influence member). In the image forming apparatus, in accordance with the temperatures of both faces of the sheet just after cooling, acquired by temperature sensors (temperature detection units) that detect the respective temperatures on the front and back sides of the sheet just after cooling, the revolutions per minute of a fan that blows air on the heat sink of the cooling member are changed, so that the temperature of the cooling member is controlled.

At the time of control of the temperatures of a plurality of temperature-influence members included in an image forming apparatus, preferably, for each temperature-influence member, a temperature detection unit detects, in practice, the temperature of a recording medium at a proper point, and then the temperature of each temperature-influence member is controlled on the basis of the corresponding detection result. However, due to various causes, such as the space of installation and the environment of installation for temperature detection units and the reduction in cost due to omission of temperature detection units, in some cases, it is difficult to install a temperature detection unit that detects in practice the temperature of a recoding medium, at a proper point for each temperature-influence member that is a target to be controlled in temperature.

SUMMARY OF THE INVENTION

According to an aspect of the present invention, an image forming apparatus includes a plurality of temperature-influence members, a first-point temperature acquisition unit, a second-point temperature estimation unit, and a controller. The plurality of temperature-influence members have influence on a temperature of a recording medium on which an image is formed. The first-point temperature acquisition unit is configured to detect or estimate a temperature of the recording medium at a first point. The second-point temperature estimation unit is configured to estimate a temperature of the recording medium at a second point, based on a detection result of at least one of a temperature of the recording medium at a point different from the second point and a temperature of a member or atmosphere. The controller is configured to control the plurality of temperature-influence members, based on an acquisition result from the first-point temperature acquisition unit and an estimation result from the second-point temperature estimation unit.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
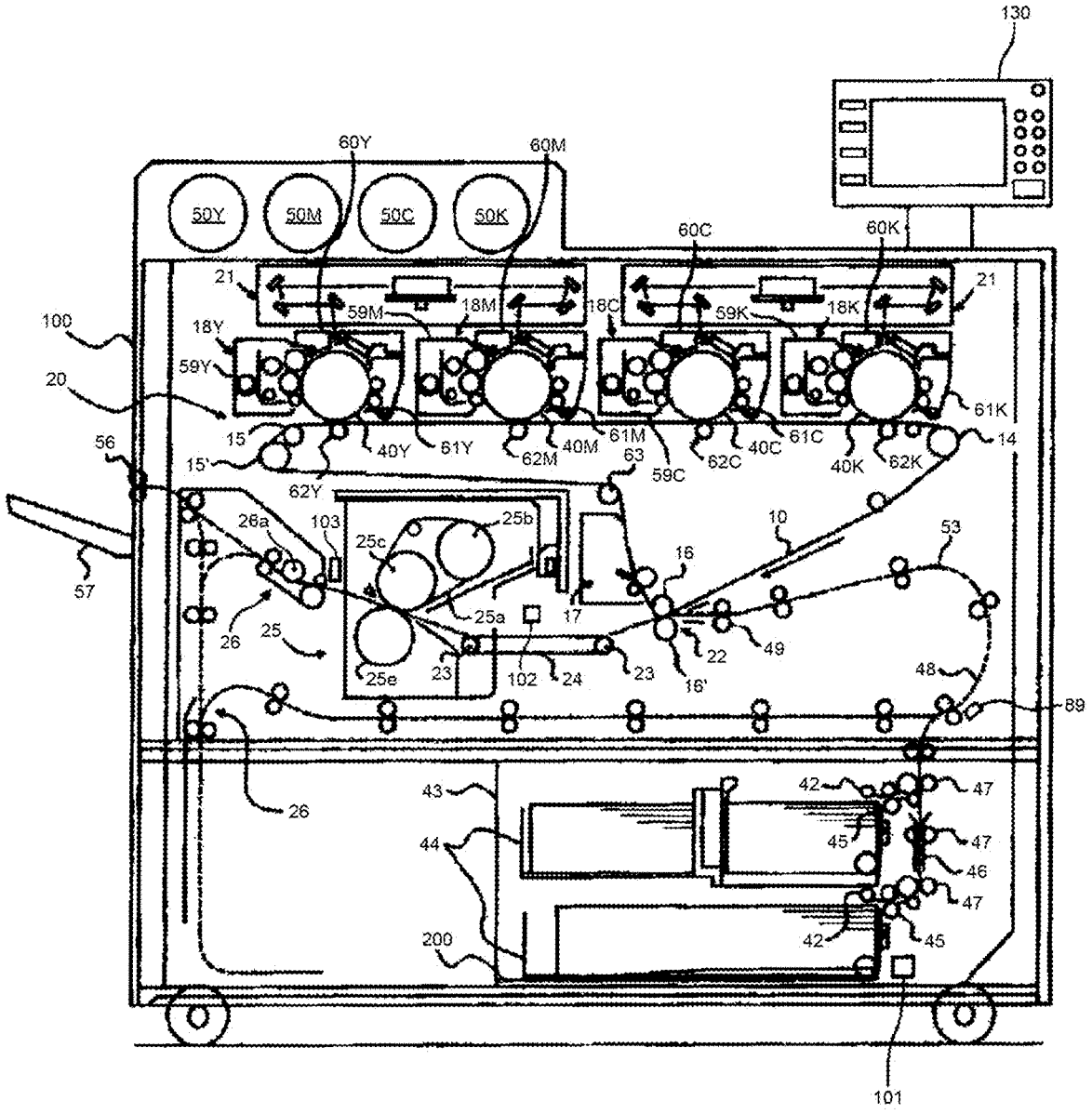
FIG. 1 is a schematic view of the configuration of a printer according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An electrophotographic printer as an image forming apparatus according to an embodiment of the present invention, will be described below.

First, the basic configuration of the printer according to the embodiment will be described.

FIG. 1 is a schematic view of the configuration of the printer according to the embodiment. In the figure, a printer 100 includes: a sheet feeding unit (sheet feeding table) that supplies a sheet feeding path with recording sheets as recording media housed inside; and a printer unit mounted on the sheet feeding unit. The indices Y, M, C, and K denoted at the ends of reference signs in the figure represent, respectively, members for yellow, magenta, cyan, and black.

In the vicinity of the center of the printer unit, an endless intermediate transfer belt 10 that is stretched around a plurality of supporting rollers 14, 15, 15', 16, and 63 and is endlessly movable clockwise in the figure is provided. A belt cleaning device 17 abuts on, from the belt front-face side, a part stretched around a cleaning backup roller in the entire region in the circumferential direction of the intermediate transfer belt 10. The belt cleaning device 17 removes transfer residual toner remaining on the front face of the intermediate transfer belt 10 having passed through a secondary transfer nip to be described later.

In the entire region in the circumferential direction of the intermediate transfer belt 10, the region between the driving roller 14 that is a supporting roller and the supporting roller 15, extends substantially horizontally. Then, a tandem image forming unit 20 is disposed above the region. The tandem image forming unit 20 keeps four image formation units 18Y, 18M, 18C, and 18K for yellow, magenta, cyan, and black disposed along the belt front face, opposed to the belt front face.

An optical writing device 21 is provided as a latent image writing unit above the tandem image forming unit 20. The image formation units 18Y, 18M, 18C, and 18K in the tandem image forming unit 20 include, respectively, drum-shaped photoconductors 40Y, 40M, 40C, and 40K as latent image bearers for formation of latent images in yellow, magenta, cyan, and black. The surfaces of the photoconductors 40Y, 40M, 40C, and 40K are charged uniformly by charging devices 60Y, 60M, 60C, and 60K, respectively (e.g., −650 V). After that, the surfaces of the photoconductors 40Y, 40M, 40C, and 40K each are optically scanned by the optical writing device 21 that drives a light source on the basis of image data. Optically irradiated portions, on the surfaces of the photoconductors 40Y, 40M, 40C, and 40K, caused by the optical scanning decrease in potential, resulting in electrostatic latent images (e.g., −50 V).

The electrostatic latent images formed on the surfaces of the photoconductors 40Y, 40M, 40C, and 40K are developed by developing devices 59Y, 59M, 59C, and 59K, resulting in Y, M, C, and K toner images, respectively. As necessary, the developing devices 59Y, 59M, 59C, and 59K are supplied with Y, M, C, and K toners from toner bottles 50Y, 50M, 50C, and 50K, respectively. Inside the developing devices 59Y, 59M, 59C, and 59K, respectively, stirred are Y, M, C, and K developers including Y, M, C, and K toners mixed with magnetic carriers, respectively. The Y, M, C, and K toners in the Y, M, C, and K developers are negatively charged by friction (e.g., −30 μC/g). Inside the developing devices 59, 59M, 59C, and 59K, respectively, disposed are developing rollers for Y, M, C, and K. The developing rollers for Y, M, C, and K each have part of the circumferential face thereof exposed outward through an opening provided at a casing. The exposed parts of the circumferential faces of the developing rollers for Y, M, C, and K are opposed to the photoconductors 40Y, 40M, 40C, and 40K. The Y, M, C, and K developers drawn by the developing rollers for Y, M, C, and K are conveyed to developing regions opposed to the photoconductors 40Y, 40M, 40C, and 40K, along with rotations of the rollers. In each developing region, developing potential for causing negative toner to move from the roller side to the latent image side acts between the electrostatic latent image on the corresponding photoconductor 40Y, 40M, 40C, or 40K and the developing roller to which a developing bias is applied (e.g., −500 V). Due to such developing potential, the Y, M, C, and K toners on the developing rollers for Y, M, C, and K separate from the magnetic carriers to transition to the electrostatic latent images on the photoconductors 40Y, 40M, 40C, and 40K. This arrangement causes the electrostatic latent images on the photoconductors 40Y, 40M, 40C, and 40K to be developed by the Y, M, C, and K toners, resulting in Y, M, C, and K toner images.

Under the photoconductors 40Y, 40M, 40C, and 40K, disposed are primary transfer rollers 62Y, 62M, 62C, and 62K that press the intermediate transfer belt 10 to the photoconductors 40Y, 40M, 40C, and 40K. This arrangement results in formation of primary transfer nips for Y, M, C, and K at which the photoconductors 40Y, 40M, 40C, and 40K abut on the intermediate transfer belt 10. On the peripheries of the primary transfer nips for Y, M, C, and K, primary transfer electric fields are formed between the primary transfer rollers 62Y, 62M, 62C, and 62K to which a primary transfer bias is applied and the electrostatic latent images on the photoconductors 40Y, 40M, 40C, and 40K.

After receiving image data, the printer 100 causes a driving unit to rotation-drive the driving roller 14, so that the intermediate transfer belt 10 endlessly moves clockwise in the figure. Simultaneously, the image formation units 18Y, 18M, 18C, and 18K are driven, resulting in formation of Y, M, C, and K toner images on the photoconductors 40Y, 40M, 40C, and 40K. The toner images are primary-transferred, in superimposition, on the front face of the intermediate transfer belt 10 at the primary transfer nips for Y, M, C, and K. This arrangement results in formation of a four-color superimposed toner image on the front face of the intermediate transfer belt 10.

Note that, for formation of a monochrome image in black on the intermediate transfer belt 10, movement of the supporting rollers 15 and 15' other than the driving roller 14 enables separation of the photoconductors 40Y, 40M, and 40C for yellow, magenta, and cyan from the intermediate transfer belt 10.

The surfaces of the photoconductors 40Y, 40M, 40C, and 40K having passed through the primary transfer nips for Y, M, C, and K, each have transfer residual toner having not been primary-transferred to the intermediate transfer belt 10, adhering thereto. Such transfer residual toner is removed from the surfaces of the photoconductors 40Y, 40M, 40C, and 40K by drum cleaning devices 61Y, 61M, 61C, and 61K, and then the removed toner is conveyed to a waste-toner bottle.

The surfaces of the photoconductors 40Y, 40M, 40C, and 40K after cleaning are charged uniformly again by the charging devices 60Y, 60M, 60C, and 60K.

The printer 100 selectively rotates one of sheet feeding rollers 42 above the sheet feeding table 200 in the sheet feeding unit. This arrangement causes a recording sheet to be fed from one of a plurality of sheet feeding cassettes 44 provided in tiers inside a paper bank 43. Then, a separation roller 45 that separates recording sheets one by one, sends a recording sheet to a sheet feeding path 48. After that, a conveyance roller 47 conveys and enters the recording sheet to the sheet feeding path 48 in the printer unit. The recording sheet having entered the sheet feeding path 48 in the printer unit hits against and stops at the registration nip between a pair of registration rollers 49.

A secondary transfer device 22 is disposed below the intermediate transfer belt 10. The secondary transfer device 22 keeps a secondary transfer roller 16' abutting on a part stretched around the secondary transfer opposing roller 16 as a supporting roller, in the entire region in the circumferential direction of the intermediate transfer belt 10, resulting in formation of a secondary transfer nip.

The pair of registration rollers 49 starts rotation-drive with timing enabling the recording sheet to be superimposed on the four-color superimposed toner image on the belt at the secondary transfer nip, to send the recording sheet to the secondary transfer nip. In the secondary transfer nip, due to the effects of a secondary transfer electric field and nip pressure, the four-color superimposed toner image on the intermediate transfer belt 10 is secondary-transferred to the recording sheet, resulting in a full-color image.

The recording sheet having passed through the secondary transfer nip, is sent to a fixing device 25, so that the full-color image is fixed on the front face of the recording sheet. The recording sheet having risen in temperature through the fixing device 25 is sent to and cooled by a cooling device 26. After that, the recording sheet is discharged outside through a pair of discharging rollers 56 and then is stacked on a sheet ejection tray 57.

Note that, in double-sided print mode in which images are formed on both faces of a recording sheet, a recording sheet having a toner image fixed on a first face of both faces thereof passes through the cooling device 26, and then is sent to a resending device 28, instead of being sent to the pair of discharging rollers 56. Then, the resending device 28 resends the recording sheet turned over, to the sheet feeding path 48. Then, the recording sheet is sent from the sheet feeding path 48 to the secondary transfer nip and then a four-color superimposed toner image is secondary-transferred to a second face thereof. After that, the recording sheet is discharged outside through the fixing device 25 and the pair of discharging rollers 56.

The intermediate transfer belt 10 having passed through the secondary transfer nip, enters the primary transfer nips for Y, M, C, and K after the belt cleaning device 17 removes transfer residual toner adhering on the surface of the intermediate transfer belt 10. The toner housed inside the belt cleaning device 17 is collected into a waste-toner bottle by a conveyance unit.

Figure 2:
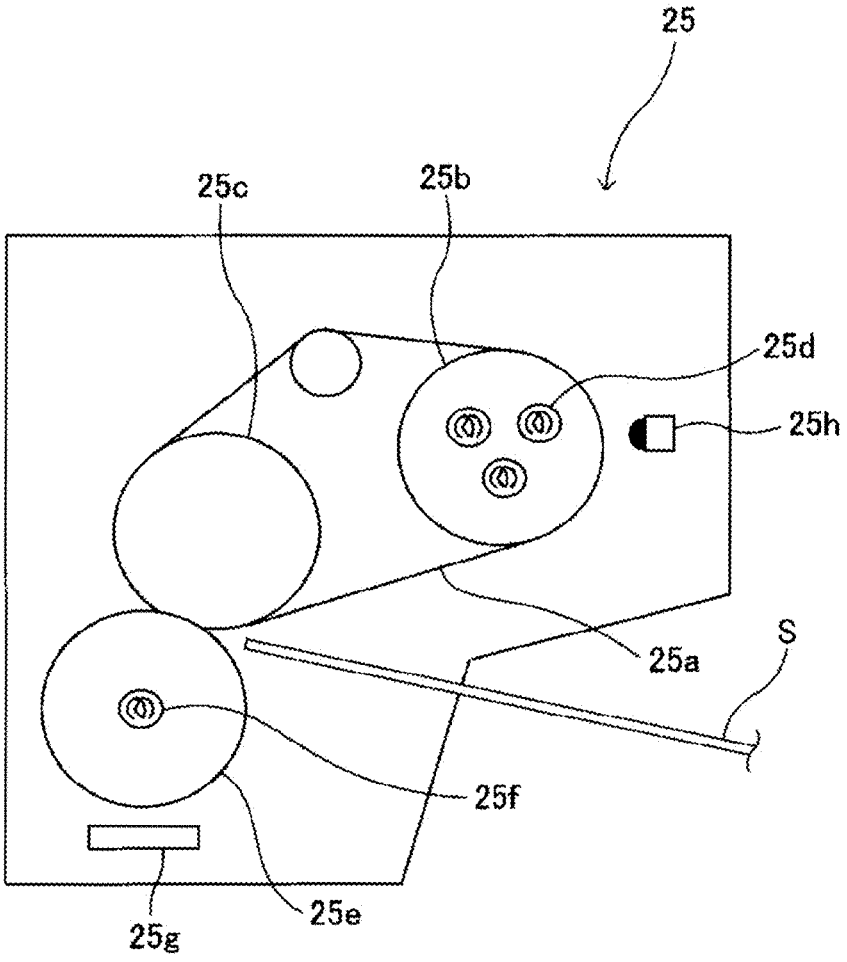
FIG. 2 is a schematic view of a fixing device in the printer.

FIG. 2 is a schematic view of the fixing device 25 in the present embodiment.

As illustrated in FIG. 2, the fixing device 25 includes a fixing belt 25*a* as a heating member that is a temperature-influence member, a heating roller 25*b*, a fixing roller 25*c*, a fixing heater 25*d* as a heating unit provided at the heating roller 25*b*, a pressing roller 25*e* as a pressing member that is a temperature-influence member, a pressing heater 25*f* as a heating unit provided at the pressing roller 25*e*, a pressing-roller fan 25*g* that cools the pressing roller 25*e*, and a temperature sensor 25*h* as a temperature detection unit.

Under a certain tension, the fixing belt 25*a* is stretched around the fixing roller 25*c* and the heating roller 25*b*. The fixing belt 25*a* is an endless belt and has a double-layered structure in which an elastic layer, such as a silicon rubber layer (300 to 500 μm), is formed on a base material, such as nickel, stainless steel, or polyimide. The fixing roller 25*c* includes silicon rubber formed on a metallic cored bar. The heating roller 25*b* is an aluminum or iron hollow roller and is provided internally with the fixing heater 25*d*.

Temperature control of the fixing belt 25*a* is performed by control of turning on and turning off energization to the fixing heater 25*d* of the heating roller 25*b*. Note that the fixing device 25 is not limited to the heaters 25*d* and 25*f* as heating units, and thus may be provided with different heating units enabling temperature control, such as a lamp and an electromagnetic induction heating device (IH heater).

The pressing roller 25*e* is located below the fixing belt 25*a*, and presses rotatably against a part of the fixing belt 25*a* that winds around the fixing roller 25*c*. The pressing roller 25*e* is an aluminum or iron hollow roller and is provided internally with the pressing heater 25*f*. Temperature control of the pressing roller 25*e* is performed by control of turning on and turning off energization to the pressing heater 25*f* of the pressing roller 25*e*.

The pressing force of the pressing roller 25*e* is given by a pressing spring as an urging unit that biases the shaft portion of the pressing roller 25*e* toward the fixing roller 25*c*. Changing the angle of rotation of a pressing cam causes displacement of a supporting member supporting the pressing spring, so that the amount of compression of the pressing spring can be changed. Therefore, control of the angle of rotation of the pressing cam causes change of the urging force of the pressing roller spring, so that the pressing force of the pressing roller 25*e* (nip pressure at a fixing nip) can be changed.

Pressing between the pressing roller 25*e* and the fixing belt 25*a* causes formation of a fixing nip. Passage of a recording sheet S through the fixing nip causes the toner image on the recording sheet S to be fixed on the recording sheet S by heat and pressure.

Figure 3:
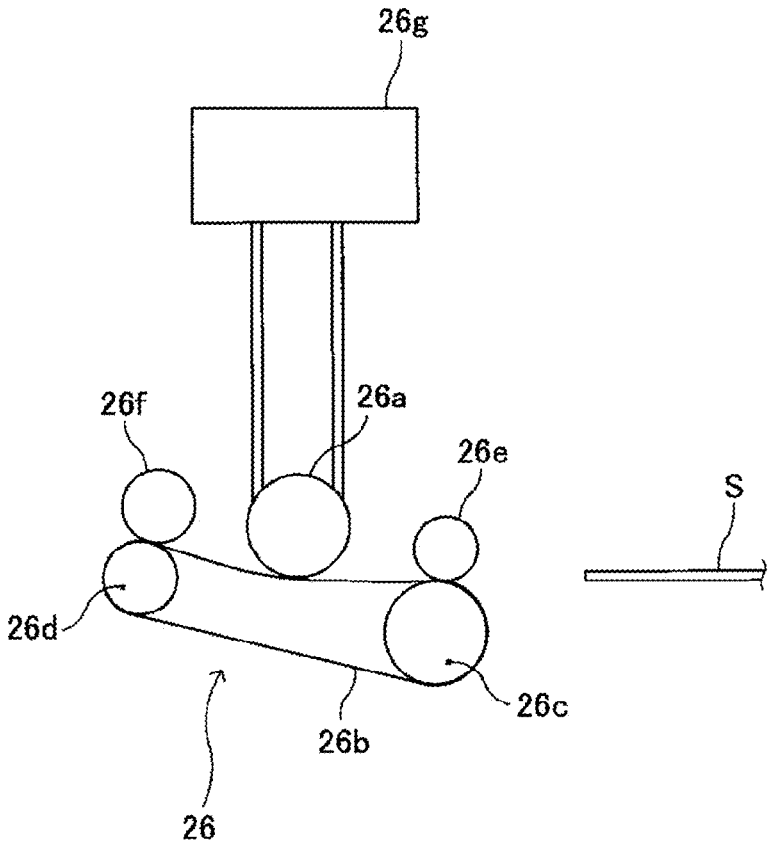
FIG. 3 is a schematic view of a cooling device in the printer.

FIG. 3 is a schematic view of the cooling device 26 in the present embodiment.

As illustrated in FIG. 3, the cooling device 26 includes a cooling roller 26*a* as a cooling member, a conveyance belt 26*b* abutting on the cooling roller 26*a* such that a cooling nip is formed, two supporting rollers 26*c* and 26*d* around which the conveyance belt 26*b* is stretched, and guide rollers 26*e* and 26*f* disposed upstream and downstream of the cooling roller 26*a* in the sheet conveyance direction.

The cooling device 26 according to the present embodiment has a water-cooling type, in which a coolant made of liquid, such as water, or gas (cooling water is used in the present embodiment) is circulated to cool the cooling roller 26*a*. A chiller (cooling-water circulation device) 26*g* adjusts the temperature of the circulating cooling water with a refrigerator and a heater, resulting in temperature control of the cooling roller 26*a*. Note that any configuration or technique may be adopted to the cooling device 26 as long as a recording sheet S can be cooled by a cooling member and the temperature of the cooling member can be controlled.

The printer 100 according to the present embodiment includes a sheet-feeding temperature sensor 101 that detects the internal temperature of the paper bank 43, a pre-fixing temperature sensor 102 that detects the temperature of the recording sheet S (recording sheet S just before fixing) between the secondary transfer device 22 and the fixing device 25, and a post-fixing temperature sensor 103 that detects the temperature of the recording sheet S (recording sheet S just after fixing) between the fixing device 25 and the cooling device 26 (first point). In addition, the present printer 100 includes, as a temperature detection unit, a fixing-belt temperature sensor 25*h* that detects the temperature of the fixing belt 25*a*. Furthermore, additional temperature sensors may be provided, such as temperature sensors that detect the temperatures in the vicinity of developing devices 59Y, 59M, 59C, and 59K, and a temperature sensor that detects the temperature in the vicinity of the pair of discharging rollers 56.

Next, as a feature according to the present invention, temperature control of the fixing belt 25*a*, the pressing roller 25*e*, and the cooling roller 26*a* that are temperature-influence members having influence on the temperature of a recording sheet S, will be described.

Figure 4:
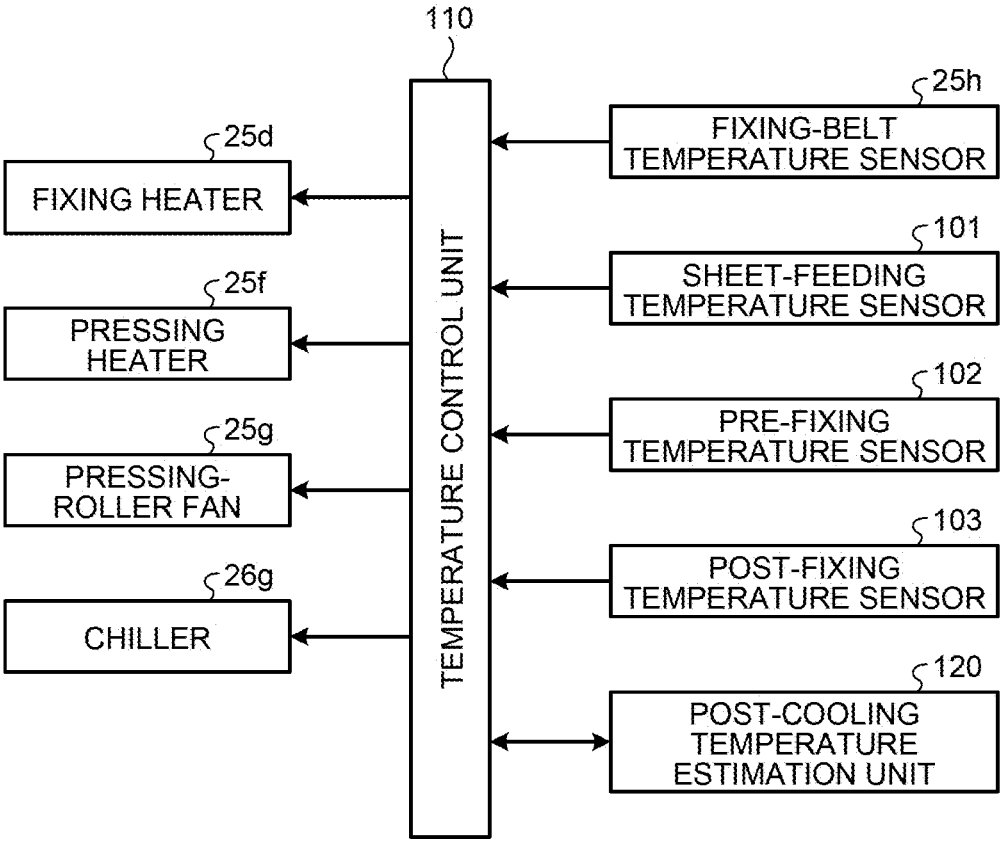
FIG. 4 is a control block diagram regarding temperature control of a fixing belt, a pressing roller, and a cooling roller in the embodiment.

FIG. 4 is a control block diagram in temperature control of the fixing belt 25*a*, the pressing roller 25*e*, and the cooling roller 26*a*.

Temperature control in the present embodiment is performed by a temperature control unit 110 as a controller. The temperature control unit 110 controls the temperatures of the fixing belt 25*a*, the pressing roller 25*e*, and the cooling roller 26*a*, on the basis of a detection result from at least one temperature sensor of the various types of temperature sensors 25*h*, 101, 102, and 103 installed in the present printer 100 and an estimation result of the temperature of the recording sheet S downstream of the cooling device 26 in the sheet conveyance direction (second point) from a post-cooling temperature estimation unit 120. An estimation program that a computer device executes in the post-cooling temperature estimation unit 120 will be described later (pre-trained model).

Temperature control of the fixing belt 25*a* is performed by control of turning on and turning off energization to the fixing heater 25*d*. Temperature control of the pressing roller 25*e* is performed by control of turning on and turning off energization to the pressing heater 25*f* and control of the revolutions per minute of the pressing-roller fan 25*g*. Temperature control of the cooling roller 26*a* is performed by control of the chiller 26*g*.

In the embodiment, too low temperatures of the fixing belt 25*a* and the pressing roller 25*e* cause a defect, such as toner offset in which toner adheres to the fixing belt 25*a*. Moreover, too high temperatures of the fixing belt 25*a* and the pressing roller 25*e* cause a defect, such as hot offset in which toner adheres to a conveyance member (e.g., the pair of discharging rollers 56) downstream of the fixing device 25 in the sheet conveyance direction or blocking in which a recording sheet stacked on the sheet ejection tray 57 sticks to the subsequent recording sheet. Moreover, too low or high temperatures of the fixing belt 25*a* and the pressing roller 25*e* cause no acquisition of the original color development, resulting in a defect, such as deterioration in image quality.

Therefore, the temperatures of the fixing belt 25*a* and the pressing roller 25*e* require controlling in a proper temperature range. The proper temperature range varies depending on the temperature-related conditions of the recording sheet S (e.g., the sheet temperature before fixing and the heat capacity and thermal conductivity of the recording sheet S).

As above, even in a case where the proper temperature range varies, for performance of favorable fixing processing, favorably, the temperatures of the fixing belt 25*a* and the pressing roller 25*e* are controlled on the basis of the temperature of the recording sheet S just before fixing and the temperature of the recording sheet S just after fixing.

That is, the temperatures of the fixing belt 25*a* and the pressing roller 25*e* are set higher with a lower temperature of the recording sheet S just before fixing, so that favorable fixing processing can be performed. Moreover, favorably, control is performed such that the temperatures of the fixing belt 25*a* and the pressing roller 25*e* are adjusted lower with a higher temperature of the recording sheet S just after fixing. As above, favorably, the temperatures of the fixing belt 25*a* and the pressing roller 25*e* in the fixing device 25 are controlled on the basis of the temperature of the recording sheet S just before fixing and the temperature of the recording sheet S just after fixing.

Thus, according to the present embodiment, the pre-fixing temperature sensor 102 that detects the temperature of the recording sheet S just before fixing and the post-fixing temperature sensor 103 that detects the temperature of the recording sheet S just after fixing are provided. On the basis of detection results therefrom, the temperatures of the fixing belt 25*a* and the pressing roller 25*e* in the fixing device 25 are controlled.

Meanwhile, too high temperatures of the fixing belt 25*a* and the pressing roller 25*e* are likely to cause blocking or the like as described above. According to the present embodiment, the cooling device 26 cools the recording sheet S after fixing, so that blocking or the like is inhibited from occurring. Note that, in a case where the temperature of the cooling roller 26*a* is too high because the cooling capacity of the cooling roller 26*a* is insufficient, sufficient cooling cannot be performed to the recording sheet S, and thus blocking cannot be sufficiently inhibited from occurring. Moreover, constantly cooling the cooling roller 26*a* at the maximum cooling capacity is unfavorable from the viewpoint of energy saving.

Therefore, the temperature of the cooling roller 26*a* requires controlling in a proper temperature range (namely, the cooling capacity is controlled in a proper range). The proper temperature range varies depending on the temperature-related conditions of the recording sheet S (e.g., the sheet temperature before cooling and the heat capacity and thermal conductivity of the recording sheet S). As above, even in a case where the proper temperature range varies, for performance of favorable cooling processing with minimum necessary energy, favorably, on the basis of the temperature of the recording sheet S just before cooling (temperature of the recording sheet S just after fixing) and the temperature of the recording sheet S just after cooling, the chiller 26*g* is controlled to control the temperature of the cooling roller 26*a*.

Thus, preferably, a temperature sensor that detects the temperature of the recording sheet S just after cooling is provided. On the basis of a detection result of the sheet temperature after cooling and a detection result from the post-fixing temperature sensor 103, the chiller 26*g* is controlled to control the temperature of the cooling roller 26*a*. However, according to the present embodiment, a branch to a conveyance path to the pair of discharging rollers 56 and a conveyance path to the resending device 28 is located just downstream of the cooling device 26 in the sheet conveyance direction. Thus, a proper space in which the temperature sensor is installed cannot be ensured.

Thus, according to the present embodiment, the post-cooling temperature estimation unit 120 estimates the temperature of the recording sheet S downstream of the cooling device 26 in the sheet conveyance direction (second point). On the basis of an estimation result therefrom, the chiller 26*g* is controlled to control the temperature of the cooling roller 26*a*.

Figure 5:
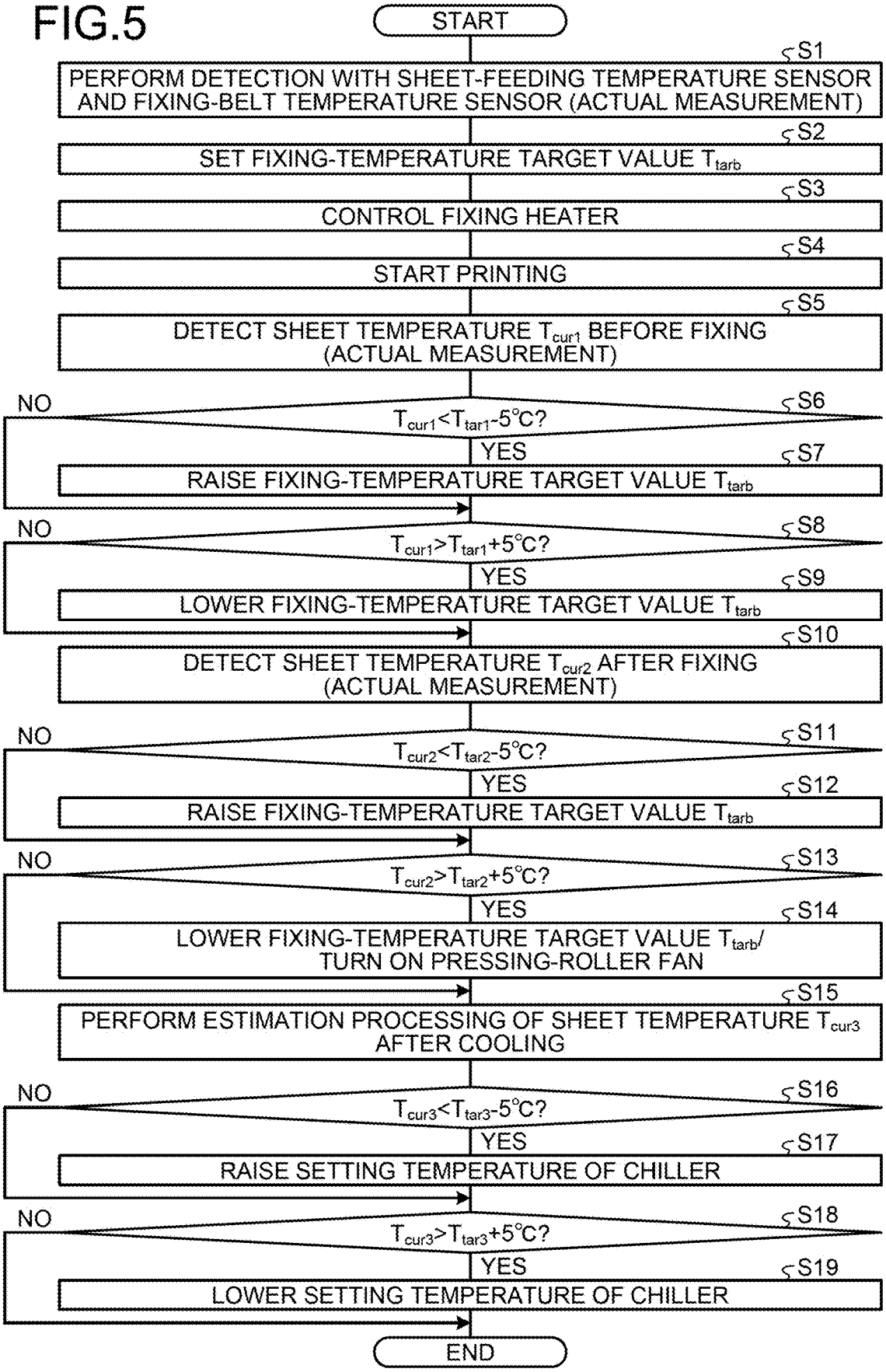
FIG. 5 is a flowchart of a flow of temperature control of the fixing belt, the pressing roller, and the cooling roller in the embodiment.

FIG. 5 is a flowchart of a flow of temperature control of the fixing belt 25*a*, the pressing roller 25*e*, and the cooling roller 26*a* in the present embodiment.

First, simultaneously with powering on the printer 100, the temperature control unit 110 acquires temperature detection results (actual measured values) from the sheet-feeding temperature sensor 101 inside the paper bank 43 and the fixing-belt temperature sensor 25*h* (S1). The temperature control unit 110 sets a target value for the temperature of the fixing belt 25*a* (fixing-temperature target value) $T_{tarb}$, taking into account the temperature detection result from the sheet-feeding temperature sensor 101 (S2). The temperature control unit 110 controls the fixing heater 25*d* such that the fixing-belt temperature $T_{curb}$ that the fixing-belt temperature sensor 25*h* detects is identical to the fixing-temperature target value $T_{tarb}$ (S3).

Printing starts (S4), and then the pre-fixing temperature sensor 102 detects (actually measures) the temperature of a recording sheet S before fixing, having a toner image transferred thereto (S5). The temperature control unit 110 verifies whether or not the sheet temperature $T_{cur1}$ before fixing detected by the pre-fixing temperature sensor 102 is in a target range (e.g., the range between the target temperature $T_{tar1}$−5° C. and the target temperature $T_{tar1}$+5° C.). (S6, S8). Then, in a case where the sheet temperature $T_{cur1}$ before fixing is below the target range (Yes in S6), the fixing-temperature target value $T_{tarb}$ is raised (S7). In a case where the sheet temperature $T_{cur1}$ before fixing is above the target range (Yes in S8), the fixing-temperature target value $T_{tarb}$ is lowered (S9).

Next, the post-fixing temperature sensor 103 detects (actually measures) the temperature of the recording sheet S after fixing (before cooling) (S10). Then, the temperature control unit 110 verifies whether or not the sheet temperature $T_{cur2}$ after fixing detected by the post-fixing temperature sensor 103 is in a target range (e.g., the range between the target temperature $T_{tar2}$−5° C. and the target temperature $T_{tar2}$+5° C.) (S11, S13). Then, in a case where the sheet temperature $T_{cur2}$ after fixing is below the target range (Yes in S11), the fixing-temperature target value $T_{tarb}$ is raised (S12). In a case where the sheet temperature $T_{cur2}$ after fixing is above the target range (Yes in S13), the fixing-temperature target value $T_{tarb}$ is lowered, the pressing-roller fan 25*g* is turned on, or the lowering and the turning on both are performed (S14). Note that, in a case where the pressing-roller fan 25*g* has already been turned on, the revolutions per minute of the pressing-roller fan 25*g* is raised.

Note that, according to the present embodiment, exemplarily, on the basis of the sheet temperature $T_{cur2}$ after fixing detected by the post-fixing temperature sensor 103, the temperatures of the fixing belt 25*a* and the pressing roller 25*e* are controlled. Alternatively, the pressing force of the pressing roller 25*e* may be controlled. Specifically, when the sheet temperature $T_{cur2}$ after fixing is below the target range, control may be performed such that the pressing force of the pressing roller 25*e* is raised, instead of control of raising the fixing-temperature target value $T_{tarb}$. When the sheet temperature $T_{cur2}$ after fixing is above the target range, control may be performed such that the pressing force of the pressing roller 25*e* is lowered, instead of control of turning on the pressing-roller fan 25*g*.

Moreover, the post-cooling temperature estimation unit 120 performs estimation processing of estimating the temperature of the recording sheet S after cooling. Then, the post-cooling temperature estimation unit 120 calculates an estimate $T_{cur3}$ for the sheet temperature after cooling and outputs the estimate $T_{cur3}$ to the temperature control unit 110 (S15). The temperature control unit 110 verifies whether or not the sheet temperature $T_{cur3}$ after cooling estimated by the post-cooling temperature estimation unit 120 is in a target range (e.g., the range between the target temperature $T_{tar3}$−5° C. and the target temperature $T_{tar3}$+5° C.) (S16, S18). Then, in a case where the sheet temperature $T_{cur3}$ after cooling is below the target range (Yes in S16), the setting temperature of the chiller 26*g* is raised (S17). Then, the cooling capacity of the cooling roller 26*a* is lowered to raise the temperature of the cooling roller 26*a*, resulting in inhibition of consumption energy in the cooling device 26. Meanwhile, in a case where the sheet temperature $T_{cur3}$ after cooling is above the target range (Yes in S18), the setting temperature of the chiller 26*g* is lowered (S19). Then, the cooling capacity of the cooling roller 26*a* is raised to lower the temperature of the cooling roller 26*a*.

In temperature control according to the present embodiment, the fixing temperature in the fixing device 25 (temperatures of the fixing belt 25*a* and the pressing roller 25*e*) is controlled on the basis of the sheet temperature $T_{cur2}$ after fixing, and the cooling capacity in the cooling device 26 (temperature of the cooling roller 26*a*) is controlled on the basis of the sheet temperature $T_{cur3}$ after cooling. This arrangement enables mutually independent control of the fixing temperature of the fixing device 25 and the cooling capacity of the cooling device 26. Thus, for example, even in a case where the fixing temperature of the fixing device 25 is controlled, the cooling capacity of the cooling device 26 is prevented from being insufficient or excessive. Conversely, even in a case where the cooling capacity of the cooling device 26 is controlled, the fixing temperature of the fixing device 25 is prevented from being insufficient or excessive. Therefore, the fixing device and the cooling device each can be controlled properly.

As a specific example, for example, with a configuration in which the sheet temperature $T_{cur2}$ after fixing is not detected and is not estimated, when the sheet temperature $T_{cur3}$ after cooling is above the target range, it cannot be discriminated whether the sheet temperature $T_{cur2}$ after fixing is above the target range or the sheet temperature $T_{cur2}$ after fixing is in the target range. At this time, control of lowering the fixing temperature of the fixing device 25 enables adjustment of the sheet temperature $T_{cur3}$ after cooling into the target range. However, if the sheet temperature $T_{cur2}$ after fixing is in the target range, the fixing temperature is made inadequate. Thus, poor fixing is likely to occur. Meanwhile, control of raising the cooling capacity of the cooling device 26 enables adjustment of the sheet temperature $T_{cur3}$ after cooling into the target range. However, if the sheet temperature $T_{cur2}$ after fixing is above the target range, the fixing temperature remains above the target range. Thus, poor fixing is likely to occur.

According to the present embodiment, when the sheet temperature $T_{cur3}$ is above the target range, it can be discriminated whether the sheet temperature $T_{cur2}$ after fixing is above the target range or the sheet temperature $T_{cur2}$ after fixing is in the target range. Therefore, at this time, in a case where the sheet temperature $T_{cur2}$ after fixing is above the target range, control of lowering the fixing temperature of the fixing device 25 enables adjustment of the sheet temperature $T_{cur2}$ after fixing into the target range and adjustment of the sheet temperature $T_{cur3}$ after cooling into the target range. Moreover, in a case where the sheet temperature $T_{cur2}$ after fixing is in the target range, control of raising the cooling capacity of the cooling device 26 without lowering the fixing temperature of the fixing device 25, enables adjustment of the sheet temperature $T_{cur3}$ after cooling into the target range with retention of the sheet temperature $T_{cur2}$ after fixing in the target range.

Moreover, as another specific example, for example, with a configuration in which the sheet temperature $T_{cur3}$ after cooling is not detected and is not estimated, when the sheet temperature $T_{cur2}$ after fixing is above the target range, it cannot be discriminated whether the sheet temperature $T_{cur3}$ after cooling is above the target range or the sheet temperature $T_{cur3}$ after cooling is in the target range. At this time, control of lowering the fixing temperature of the fixing device 25 enables adjustment of the sheet temperature $T_{cur2}$ after fixing into the target range. However, if the sheet temperature $T_{cur3}$ after cooling is in the target range, the sheet temperature $T_{cur3}$ after cooling lowers more than necessary, resulting in excessive cooling capacity of the cooling device 26. Thus, such a situation is unfavorable from the viewpoint of energy saving.

According to the present embodiment, when the sheet temperature $T_{cur2}$ after fixing is above the target range, it can be discriminated whether the sheet temperature $T_{cur3}$ after cooling is above the target range or the sheet temperature $T_{cur3}$ after cooling is in the target range. Therefore, at this time, in a case where the sheet temperature $T_{cur3}$ after cooling is above the target range, control of lowering the fixing temperature of the fixing device 25 enables adjustment of the sheet temperature $T_{cur2}$ after fixing into the target range and adjustment of the sheet temperature $T_{cur3}$ after cooling into the target range. Moreover, in a case where the sheet temperature $T_{cur3}$ after cooling is in the target range, control of lowering the fixing temperature of the fixing device 25 enables adjustment of the sheet temperature $T_{cur2}$ after fixing into the target range, and additionally control of lowering the cooling capacity of the cooling device 26 enables retention of the sheet temperature $T_{cur3}$ after cooling in the target range with inhibition of consumption energy in the cooling device 26.

Furthermore, according to the embodiment, for the temperature $T_{cur3}$ of the recording sheet S after cooling, used is an estimate from the post-cooling temperature estimation unit 120, instead of an actual measured value from a temperature sensor. Thus, even under a situation where the temperature sensor cannot be installed, the temperature control according to the present embodiment described above is possible. Moreover, even under a situation where the temperature sensor can be installed, cost-cutting can be achieved without installation of the temperature sensor.

Next, estimation processing of estimating the temperature $T_{cur3}$ of the recording sheet S after cooling in the post-cooling temperature estimation unit 120, will be described. The post-cooling temperature estimation unit 120 according to the present embodiment estimates the temperature $T_{cur3}$ of the recording sheet S after cooling with a model optimized by machine learning (pre-trained model). However, the post-cooling temperature estimation unit 120 is not limited to this, and thus may estimate the temperature $T_{cur3}$ of the recording sheet S after cooling with a different method (method with a computer program programmed by humans).

Note that manifold are factors having influence on the temperature $T_{cur3}$ of the recording sheet S after cooling. Furthermore, such factors often influence each other. Thus, use of an estimation program created by machine learning (pre-trained model) is advantageous to estimation with higher accuracy.

A method of creating a pre-trained model as an estimation program that a computer device executes in the post-cooling temperature estimation unit 120, will be described. The pre-trained model in the present embodiment estimates the temperature of the recording sheet S (temperature $T_{cur3}$ of the recording sheet S after cooling) downstream of the cooling device 26 in the sheet conveyance direction (second point), on the basis of various types of data, such as detection results from sensors including the various types of temperature sensors installed in the printer 100, input information from a user (operation information to an input panel 130), and predetermined setting values. Thus, according to the present embodiment, the printer 100 as a test machine is equipped with a measuring instrument that measures (actually measures) the temperature $T_{cur3}$ of the recording sheet S after cooling. Created is a large amount of data for learning including the various types of data, described above, acquired in the printer 100 and a measured value from the measuring instrument. A model is caused to learn with a data set for learning including such a large amount of data for learning, resulting in creation of the pre-trained model described above.

According to the present embodiment, used are various types of data detected by, for example, the temperature sensors 101, 102, and 103 that each detect the sheet temperature, temperature sensors that detect the temperatures of members or the temperature of atmosphere (e.g., the fixing-belt temperature sensor 25*h*, the temperature sensors that detect the temperatures in the vicinity of the developing devices, and the temperature sensor that detects the temperature in the vicinity of the pair of discharging rollers), and a humidity sensor that detects humidity, installed in the printer 100.

Then, according to the present embodiment, learning is performed by input of data for learning to a mathematical model called a neural network, resulting in calculation of an optimum model that estimates the temperature $T_{cur3}$ of the recording sheet S after cooling. In machine learning, an algorithm automatically determines parameters for the model such that the output to input data is optimized.

Figure 6:
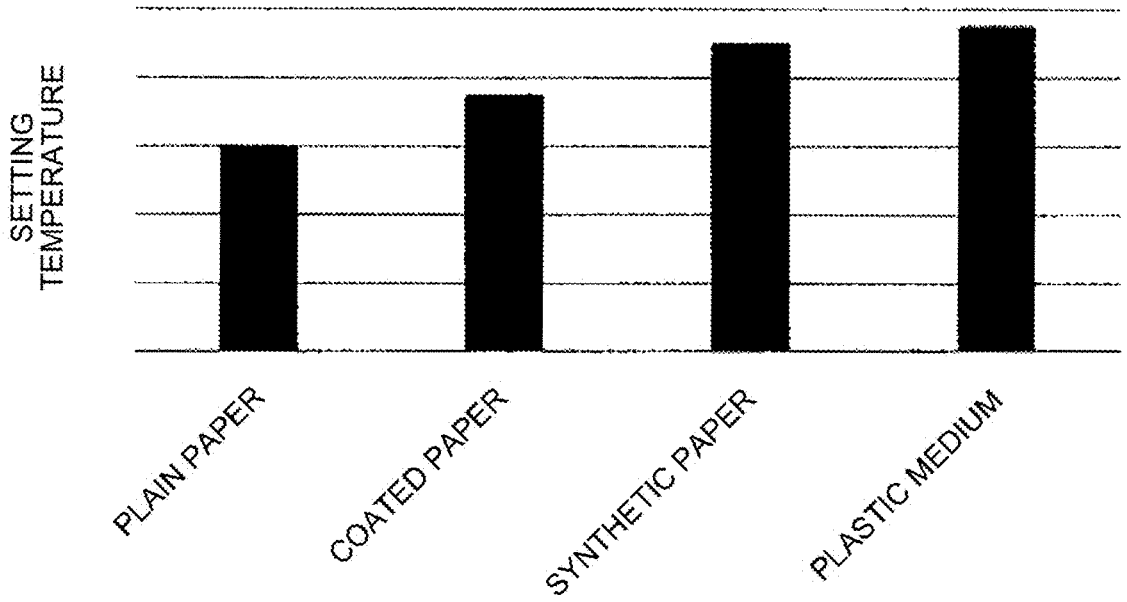
FIG. 6 is a graph of the relationship between brands of recording sheets and target values for fixing temperature.

Here, the sheet temperature as a target to be estimated in the present embodiment is considerably influenced by the temperature-related characteristics of the recording sheet S, specifically, the values of physical properties, such as the surface property, material, basis weight, and thermal conductivity of the recording sheet S, and an environment-dependent value, such as water content. Such influence is obvious from, as illustrated in FIG. 6, the fact that the target value for the fixing temperature (optimum fixing temperature) varies between different brands of recording sheets S. For example, coated paper is smaller in surface roughness than plain paper and has difficulty in acquiring anchor effect. Thus, a larger quantity of heat is required for fixing toner onto a sheet. Moreover, synthetic paper, metallic paper, and a plastic medium are smaller in surface roughness, and thus a larger quantity of heat is required. Similarly, the difference in surface-layer material or thermal conductivity, causes difference in the quantity of heat necessary for fixing toner. Thus, in a case where the target value for the fixing temperature is changed in accordance with types of recording sheets S, the temperature $T_{cur3}$ of the recording sheet S after cooling varies in accordance with the changed target value.

Therefore, in a case where the target value for the fixing temperature is changed in accordance with types of recording sheets S, as data for learning for use in machine learning, addition of the values of physical properties of the recording sheet S, such as the surface-layer material, basis weight, surface roughness, wettability, and thermal conductivity, enables higher-accuracy estimation processing.

As above, according to the present embodiment, exemplarily, with no temperature sensor that detects the temperature of the recording sheet S (sheet temperature $T_{cur3}$ after cooling) downstream of the cooling device 26 in the sheet conveyance direction (second point), used is an estimate for the sheet temperature after cooling, estimated by the post-cooling temperature estimation unit 120. However, an estimate may be used instead of a temperature sensor that detects the temperature of the recording sheet S at a different point. For example, a temperature sensor that detects the sheet temperature $T_{cur3}$ after cooling is provided, and an actual measured value may be used for the sheet temperature $T_{cur3}$ after cooling. Meanwhile, with no temperature sensor that detects the sheet temperature $T_{cur2}$ after fixing, an estimate may be used as the sheet temperature $T_{cur2}$ after fixing.

Moreover, according to the present embodiment, exemplarily, the temperature of the fixing device 25 (temperatures of the fixing belt 25*a* and the pressing roller 25*e*) is controlled on the basis of an actual measured value from the post-fixing temperature sensor 103 that detects the temperature of the recording sheet S (sheet temperature $T_{cur2}$ after fixing) between the fixing device 25 and the cooling device 26 (first point). Meanwhile, the temperature of the cooling device 26 (temperature of the cooling roller 26*a*) is controlled on the basis of an estimate for the temperature of the recording sheet S (sheet temperature $T_{cur3}$ after cooling)

downstream of the cooling device 26 in the sheet conveyance direction (second point). However, targets to be controlled are not limited to those members.

For example, a configuration in which a temperature sensor that detects the temperature of the recording sheet S (sheet front-face temperature after fixing) at a point on the front side between the fixing device 25 and the cooling device 26 (first point) is provided and the temperature of the fixing belt 25*a* is controlled on the basis of an actual measured value therefrom, and additionally, with no temperature sensor that detects the temperature of the recording sheet S (sheet back-face temperature after fixing) at a point on the back side between the fixing device 25 and the cooling device 26 (second point), the temperature of the pressing roller 25*e* is controlled on the basis of an estimate therefor can be adopted.

The descriptions given above are exemplary, and a unique effect is provided by every aspect below.

First Aspect

According to a first aspect, an image forming apparatus (e.g., the printer 100) includes: a plurality of temperature-influence members (e.g., the fixing belt 25*a*, the pressing roller 25*e*, and the cooling roller 26*a*) having influence on a temperature of a recording medium (e.g., the recording sheet S) on which an image is formed; a first-point temperature acquisition unit (e.g., the post-fixing temperature sensor 103) configured to detect or estimate a temperature of the recording medium (e.g., the sheet temperature $T_{cur2}$ after fixing) at a first point (e.g., between the fixing device 25 and the cooling device 26); a second-point temperature estimation unit (e.g., the post-cooling temperature estimation unit 120) configured to estimate a temperature of the recording medium (e.g., the sheet temperature $T_{cur3}$ after cooling) at a second point (e.g., downstream of the cooling device 26 in the sheet conveyance direction), based on a detection result from a temperature detection unit (e.g., the pre-fixing temperature sensor 102, the post-fixing temperature sensor 103, the fixing-belt temperature sensor 25*h*, or the sheet-feeding temperature sensor 101) configured to detect at least one of a temperature of the recording medium at a point different from the second point (e.g., the sheet temperature $T_{cur1}$ before fixing or the sheet temperature $T_{cur2}$ after fixing) and a temperature of a member (e.g., the fixing belt 25*a*) or atmosphere (e.g., inside the paper bank 43); and a controller (e.g., the temperature control unit 110) configured to control the plurality of temperature-influence members, based on an acquisition result from the first-point temperature acquisition unit and an estimation result from the second-point temperature estimation unit. According to the present aspect, for control of the plurality of temperature-influence members, used are the temperature of the recording medium at the first point detected or estimated by the first-point temperature acquisition unit and the temperature of the recording medium at the second point estimated by the second-point temperature estimation unit. Thus, even in a case where it is difficult to install a temperature detection unit configured to detect in practice the temperature of the recording medium, at the second point that is a point suitable for temperature detection, a temperature-influence member proper to control on the basis of the temperature of the recording medium at the second point, can be subjected to the control.

Note that the temperature at the first point may be estimated instead of being detected, similarly to the estimation at the second point.

Second Aspect

According to a second aspect, in the first aspect, the plurality of temperature-influence members include: a heating member (e.g., the fixing belt 25*a*) configured to heat the recording medium to fix the image on the recording medium; and a cooling member (e.g., the cooling roller 26*a*) configured to cool the recording medium after fixing.

According to the second aspect, even in a case where it is difficult to install a temperature detection unit configured to detect a recording-medium temperature proper for control of either the heating member or the cooling member, the either member can be controlled on the basis of the temperature.

Third Aspect

According to a third aspect, in the second aspect, one of the first point and the second point is a point between the heating member and the cooling member on a recording-medium conveyance path, and the other is a point downstream of the cooling member on the recording-medium conveyance path in a recording-medium conveyance direction.

According to the third aspect, the heating member and the cooling member each can be controlled on the basis of the temperature of the recording medium at a proper point.

Fourth Aspect

According to a fourth aspect, in any of the first to third aspects, the plurality of temperature-influence members include: a heating member (e.g., the fixing belt 25*a*) configured to heat the recording medium to fix the image on the recording medium; and a pressing member (the pressing roller 25*e*) configured to pinch the recording medium between the heating member and the pressing member to press the recording medium. According to the fourth aspect, even in a case where it is difficult to install a temperature detection unit configured to detect a recording-medium temperature proper for control of either the heating member or the pressing member, the either member can be controlled on the basis of the temperature.

Fifth Aspect

According to a fifth aspect, in the fourth aspect, one of the first point and the second point is a point on a front side of the recording medium downstream of the heating member in a recording-medium conveyance direction, and the other is a point on a back side of the recording medium downstream of the heating member in the recording-medium conveyance direction.

According to the fifth aspect, the heating member and the pressing member each can be controlled on the basis of the temperature of the recording medium at a proper point.

Sixth Aspect

According to a sixth aspect, in any of the first to fifth aspects, the second-point temperature estimation unit is configured to cause a computer to execute an estimation program having learnt with a plurality of data for learning including detection results from a temperature detection configured to detect at least one of a temperature of a recording medium at the point different from the second point and a temperature of a recording-medium contact member configured to contact with the recording medium and detection results from a temperature detection unit configured to detect a temperature of the recording medium at the second point, to perform the estimation.

According to the sixth aspect, even in a case where manifold are factors having influence on the temperature of the recording medium at the second point that is a target to be estimated and additionally the factors influence each other, the temperature of the recording medium at the second point can be estimated with higher accuracy.

Seventh Aspect

According to a seventh aspect, the image forming apparatus in any of the first to sixth aspects, further includes an acquisition unit (e.g., the input panel 130) configured to acquire temperature-related information regarding the recording medium (e.g., the values of physical properties of the recording sheet S), in which the second-point temperature estimation unit is configured to estimate the temperature of the recording medium at the second point, based on also the temperature-related information acquired by the acquisition unit. According to the seventh aspect, the temperature of the recording medium at the second point can be estimated with higher accuracy.

Eighth Aspect

According to an eighth aspect, in the seventh aspect, the second-point temperature estimation unit is configured to cause a computer to execute an estimation program having learnt with a plurality of data for learning including detection results from a temperature detection unit configured to detect at least one of a temperature of a recording medium at the point different from the second point and a temperature of a recording-medium contact member configured to contact with the recording medium, temperature-related information regarding the recording medium, and detection results from a temperature detection unit configured to detect a temperature of the recording medium at the second point, to perform the estimation.

According to the sixth aspect, even in a case where manifold are factors having influence on the temperature of the recording medium at the second point that is a target to be estimated and additionally the factors influence each other, the temperature of the recording medium at the second point can be estimated with higher accuracy.

According to an embodiment, even for a temperature-influence member for which it is difficult to detect in practice the temperature of a recording medium at an optimum point with a temperature detection unit, temperature control can be performed with an estimate for the temperature of a recording medium at the point.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

a plurality of temperature-influence devices configured to increase or decrease a temperature of a recording medium on which an image is formed;

a first-point temperature sensor configured to detect or estimate a first temperature of the recording medium at a first point, the first point being a point before the recording medium is cooled; and processing circuitry configured to, estimate a second temperature of the recording medium at a second point based on a detection result of at least one of a third temperature of the recording medium at a third point different from the first point and the second point, and a fourth temperature of a member or atmosphere, and control the plurality of temperature-influence device based on the first temperature and the estimated second temperature.

2. The image forming apparatus according to claim 1, wherein the plurality of temperature-influence device include:

at least one heating member configured to heat the recording medium to fix the image on the recording medium; and at least one cooling member configured to cool the recording medium after fixing.

3. The image forming apparatus according to claim 2, wherein one of the first point and the second point is a point between the at least one heating member and the at least one cooling member on a recording-medium conveyance path, and another is a point downstream of the at least one cooling member on the recording-medium conveyance path in a recording-medium conveyance direction.

4. The image forming apparatus according to claim 1, wherein the plurality of temperature-influence device include:

at least one heating member configured to heat the recording medium to fix the image on the recording medium; and at least one pressing member configured to pinch the recording medium between the at least one heating member and the at least one pressing member to press the recording medium.

5. The image forming apparatus according to claim 4, wherein one of the first point and the second point is a point on a front side of the recording medium downstream of the at least one heating member in a recording-medium conveyance direction, and another is a point on a back side of the recording medium downstream of the at least one heating member in the recording-medium conveyance direction.

6. The image forming apparatus according to claim 1, wherein the processing circuity is further configured to:

execute an estimation program to perform the estimation, the estimation program having learnt with a plurality of data for learning including detection results from at least one temperature sensor configured to detect at least one of a temperature of a recording medium at the point different from the second point and a temperature of a recording-medium contact member configured to contact with the recording medium, and detection results from a temperature sensor configured to detect a temperature of the recording medium at the second point.

7. The image forming apparatus according to claim 1, wherein the processing circuity is further configured to:

acquire temperature-related information regarding the recording medium; and estimate the temperature of the recording medium at the second point based on also the acquired temperature-related information regarding the recording medium.

8. The image forming apparatus according to claim 7, wherein the processing circuity is further configured to:

execute an estimation program to perform the estimation, the estimation program having learnt with a plurality of data for learning including detection results from at least one temperature sensor configured to detect at least one of a temperature of a recording medium at the point different from the second point and a temperature of a recording-medium contact member configured to contact with the recording medium, temperature-related information regarding the recording medium, and detection results from a temperature sensor configured to detect a temperature of the recording medium at the second point.

9. The image forming apparatus according to claim 7, wherein the temperature-related information of the recording medium include at least one of:

a surface property of the recording medium, a material of the recording medium, a basis weight of the recording medium, a thermal conductivity of the recording medium, water content of the recording medium, or any combinations thereof.

10. The image forming apparatus according to claim 1, wherein the processing circuitry is further configured to:

control each of the plurality of temperature-influence devices based on a desired temperature ranges corresponding to each of the plurality of respective temperature-influence devices and a detected or estimated temperature corresponding to a location of each of the plurality of temperature-influence devices.

11. The image forming apparatus according to claim 1, wherein the plurality of temperature-influence devices include at least one of:

a heating roller, a pressing roller, a fixing device, a cooling device, or any combinations thereof.

12. The image forming apparatus according to claim 1, wherein the first-point temperature sensor includes at least one of sheet-feeding temperature sensor, a fixing-belt temperature sensor, a toner temperature sensor, a discharging roller sensor, or any combinations thereof.

13. The image forming apparatus according to claim 1, wherein the processing circuitry is further configured to perform the estimate of the second temperature of the recording medium based on operation settings of the image forming apparatus input by a user.

14. A method of operating an image forming apparatus including a plurality of temperature-influence devices, the method comprising:

detecting or estimating a first temperature of a recording medium at a first point using a first-point temperature sensor, the first point being a point before the recording medium is cooled;

estimating a second temperature of the recording medium at a second point based on a detection result of at least one of a third temperature of the recording medium at a third point different from the first point and the second point, and a fourth temperature of a member or atmosphere; and controlling the plurality of temperature-influence devices based on the first temperature and the estimated second temperature.

15. The method according to claim 14, wherein the plurality of temperature-influence devices include at least one heating member and at least one cooling member; and the method further includes, heating the recording medium using the at least one heating member to fix the image on the recording medium; and cooling the recording medium using the at least one cooling member after fixing.

16. The method according to claim 15, wherein one of the first point and the second point is a point between the at least one heating member and the at least one cooling member on a recording-medium conveyance path, and another is a point downstream of the at least one cooling member on the recording-medium conveyance path in a recording-medium conveyance direction.

17. The method according to claim 14, the method further comprising:

performing the estimation using an estimation program having learnt with a plurality of data for learning including detection results from at least one temperature sensor configured to detect at least one of a temperature of a recording medium at the point different from the second point and a temperature of a recording-medium contact member configured to contact with the recording medium, and detection results from a temperature sensor configured to detect a temperature of the recording medium at the second point.

* * * * *